United States Patent [19]

Kreeger et al.

[11] Patent Number: 4,905,833

[45] Date of Patent: Mar. 6, 1990

[54] NESTABLE AND STACKABLE CONTAINER

[75] Inventors: Elsmer W. Kreeger, Howell; Robert V. Cheeseman, Webberville, both of Mich.

[73] Assignee: Pinckney Molded Plastics, Inc., Howell, Mich.

[21] Appl. No.: 311,519

[22] Filed: Feb. 15, 1989

[51] Int. Cl.[4] ..... B65D 21/00

[52] U.S. Cl. ..... 206/506; 206/511; 206/516; 206/519

[58] Field of Search ..... 206/505, 506, 511, 519, 206/516; 220/380

[56] References Cited

U.S. PATENT DOCUMENTS

| | | | |
|---|---|---|---|
| Re. 32,223 | 8/1986 | Kreeger et al. | 206/506 |
| 2,765,099 | 10/1956 | Lively | 220/97 |
| 3,220,603 | 11/1965 | Bromley | 220/83 |
| 3,951,265 | 4/1976 | Carroll | 206/506 |
| 4,106,623 | 8/1978 | Carroll et al. | 206/506 |
| 4,109,791 | 8/1978 | Clipson et al. | 206/506 |
| 4,247,004 | 1/1981 | Bird | 206/505 |
| 4,270,678 | 6/1981 | Drader | 294/169 |
| 4,466,541 | 8/1984 | Tabler | 206/506 |
| 4,643,310 | 2/1987 | Deaton | 206/506 |

FOREIGN PATENT DOCUMENTS

| | | | |
|---|---|---|---|
| 7606604 | 12/1977 | Netherlands | 220/506 |

*Primary Examiner*—Stephen Marcus
*Assistant Examiner*—Nova Stucker
*Attorney, Agent, or Firm*—Basile and Hanlon

[57] ABSTRACT

A nestable and stackable container is provided with the bottom, end walls and side walls fixedly secured to each other to form a unitary structure. The container further comprises a plurality of alternately inwardly and outwardly offset portions on the side walls extending upwardly from the bottom, the inwardly offset portions each having a generally horizontal shoulder defining its upper edge. A stacking shelf is mounted on each side wall for pivotal movement about a horizontal axis extending longitudinally of the side wall at a location below and outwardly of the wall from the shoulder. The stacking shelf is pivotal about the axis, between a stacking position wherein the shelf overlies and projects inwardly of the shoulder, and a nesting position wherein the shelf is inclined upwardly and outwardly of the shoulder. A stacking rail is formed at the bottom of each opposed side wall, with the rail being receivable in a recess formed in the stacking shelf when the shelf is in its stacking position. A generally flat interference surface on the shelf is spaced from and oriented relative to the pivotal axis such that the interference surface yieldably slides across the shoulder of the inwardly offset portion to frictionally resist pivotal movement of the shelf through at least an intermediate portion of its movement between the nesting and stacking positiions. The container further comprises a plurality of bail structures formed in and horizontally spaced along the shelf.

3 Claims, 4 Drawing Sheets

NESTABLE AND STACKABLE CONTAINER

BACKGROUND OF THE INVENTION

1. Field of the Invention

This invention relates generally to containers and more particularly to containers which can be nested or stacked.

2. Description of the Prior Art

Containers of the nesting and stacking type are well known in the art. Commonly, the nesting or stacking is achieved by arranging a second container in a different orientation from the lower container. These types of containers are disadvantageous in that time and effort must be expended to ensure that an upper container is correctly oriented in order to achieve the desired nesting or stacking.

In U.S. Pat. No. 4,109,791 issued to Clipson, this particular problem is solved in that the container disclosed uses bail structures which move between a nesting or stacking position and allow a plurality of containers to be nested or stacked one on the other in like orientation. These bail structures are yieldingly restrained from movement by buttons molded integrally on the end surfaces of abutting pivot portions. However, these buttons complicate the molding of the pivot portions.

Thus, it would be desirable to provide a nestable and stackable container with a simpler design which could be nested or stacked one on top of the other in like orientation for yieldingly resisting movement of a bail structure from the nesting or stacking position.

SUMMARY OF THE INVENTION

The above-mentioned problems are solved by the nestable and stackable container of the present invention. The container comprises a rectangular bottom with first and second opposed end walls fixedly secured to and projecting upwardly from respective opposite end edges of the bottom. First and second opposed side walls are fixedly secured to and project upwardly from respective opposite side edges of the bottom. The bottom, end walls and side walls are secured to each other to form a unitary structure.

A plurality of alternately inwardly and outwardly offset portions are formed on each side wall, with the inwardly offset portions each having a generally horizontal shoulder defining its upper edge. A stacking shelf is mounted on each side wall for pivotal movement about a horizontal axis extending longitudinally of the side wall at a location below and outwardly of the wall from the shoulder. The shelf is pivotal about the axis between a stacking position wherein the shelf overlies and projects inwardly of the shoulder, and a nesting position wherein the shelf is inclined upwardly and outwardly of the shoulder.

A stacking rail is formed along the bottom of each opposed side wall. The rail is receivable in a recess formed in the stacking shelf when the shelf is in its stacking position. When the shelf is in the nesting position, the rail serves to keep the containers from wedging tightly together. The container further comprises interference means on the shelf in the form of a generally flat interference surface spaced from and oriented relative to the pivotal axis of the stacking shelf for frictionally resisting pivotal movement of the shelf through at least an intermediate portion of its movement between the nesting and stacking positions when the interference surface yieldably slides across the shoulder. The container further comprises a plurality of bail structures formed in and horizontally spaced along the shelf.

Other objects and features of the invention will become apparent by reference to the following specification and to the drawings.

DETAILED DESCRIPTION OF THE PREFERRED EMBODIMENT

Figure 1:
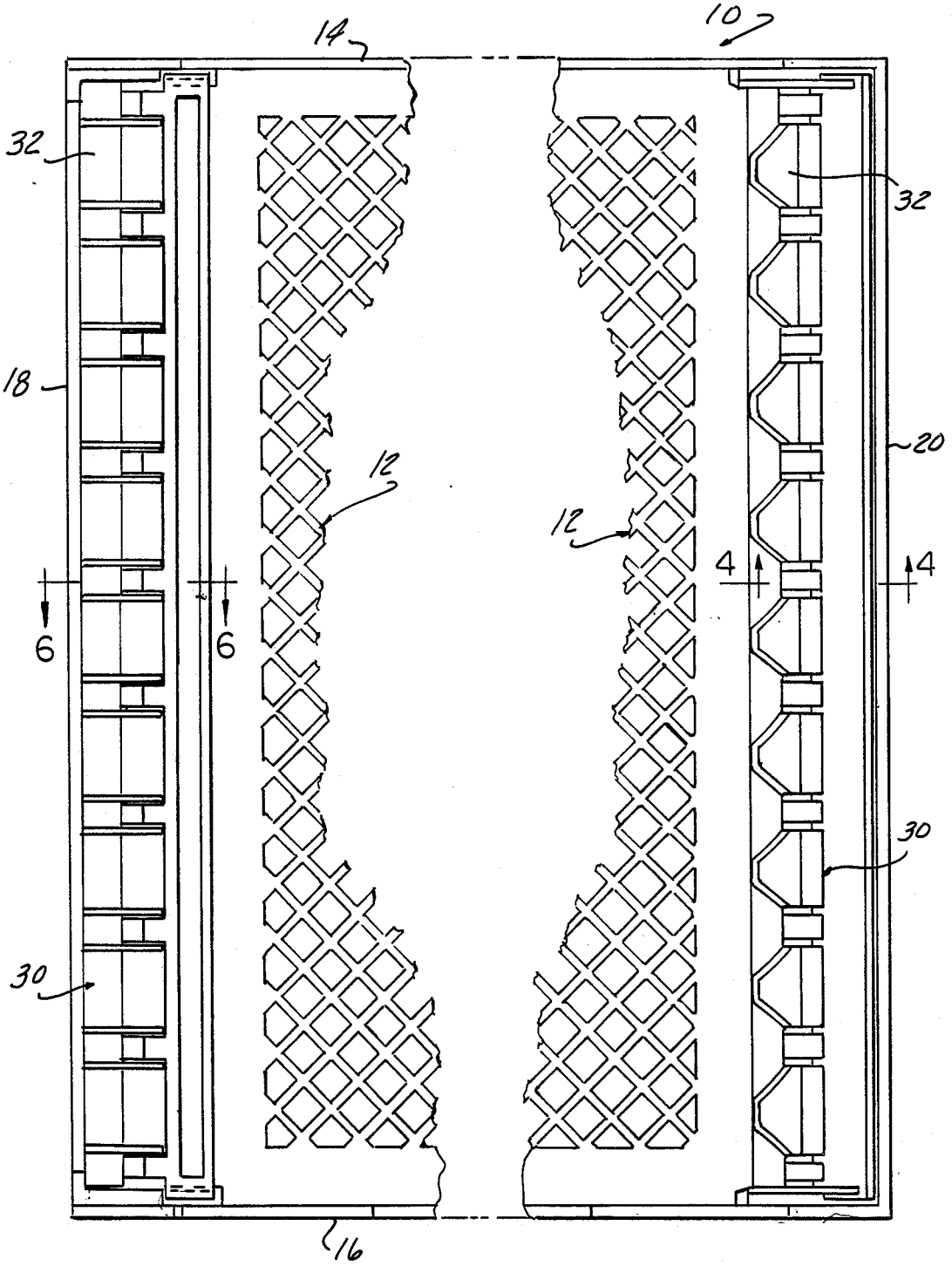
FIG. 1 is a top view, partially broken away, of the container of the present invention.

Referring now to FIG. 1, a nestable and stackable container of the present invention is generally denoted 10. The container 10 comprises a rectangular bottom 12 which may be of an open grid work. First and second opposed end walls 14 and 16 respectively, are fixedly secured to and project upwardly from respective opposite end edges of bottom 12. First and second opposed side walls 18 and 20 respectively, are fixedly secured to and project upwardly from respective opposite side edges of bottom 12. Bottom 12, end walls 14, 16 and side walls 18, 20 are formed of a suitable thermoplastic material, such as polyethylene, and are fixedly secured to each other to form a unitary structure. Since side walls 18, 20 are mirror images of each other, only one side wall will be explained in detail.

Figure 4:
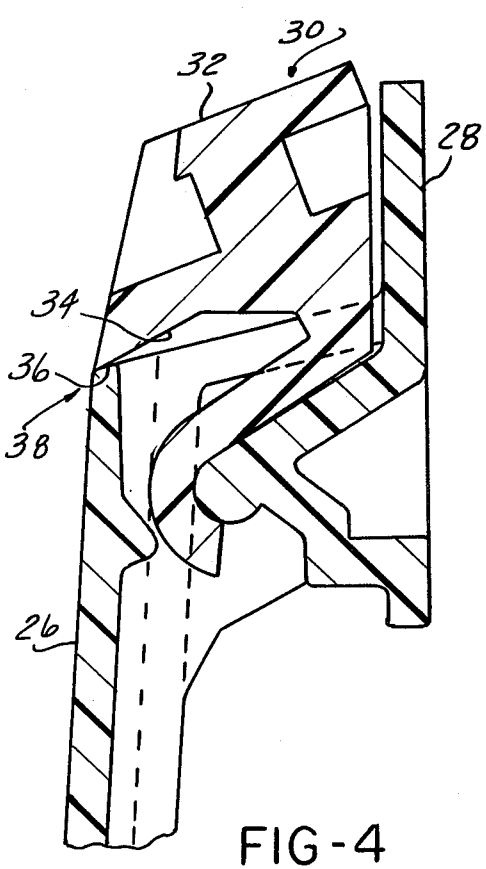
FIG. 4 is an enlarged cross section taken on line 4—4 of FIG. 1 showing the bail structure in its upward nesting position.
Figure 7:
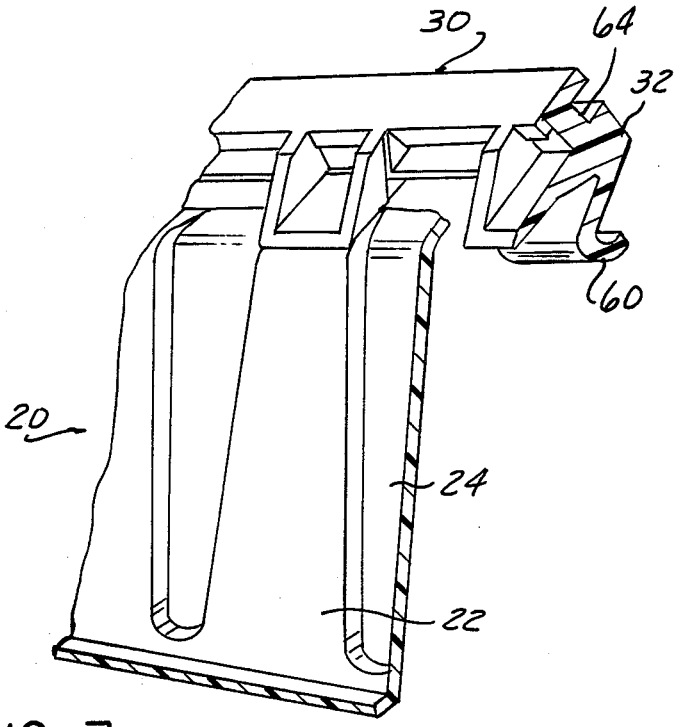
FIG. 7 is a perspective view, partially broken away and partially in cross section, looking at one side wall from the interior of the container of the present invention.
Figure 9:
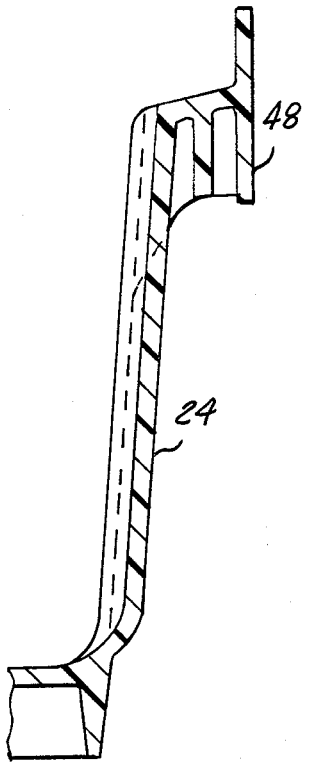
FIG. 9 is a detail cross section taken on line 9—9 of FIG. 8.
Figure 8:
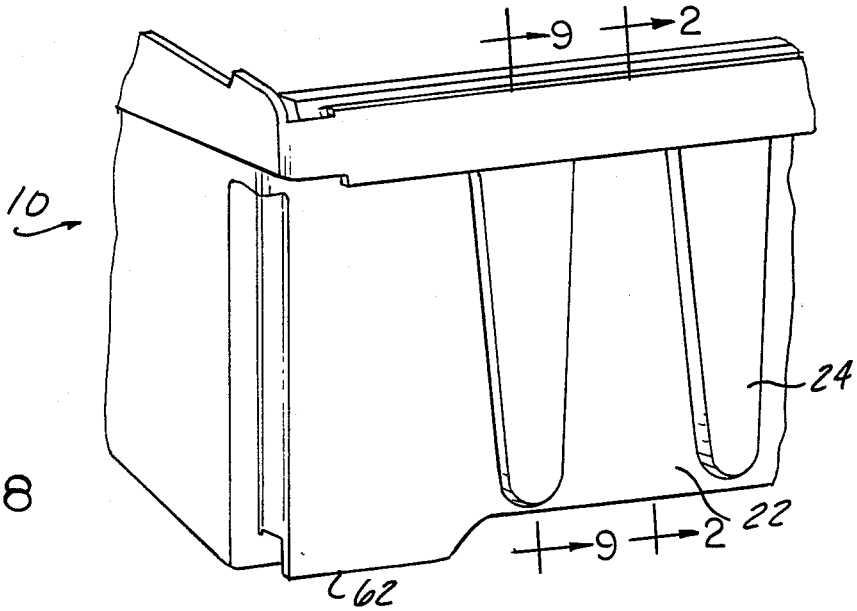
FIG. 8 is a perspective view, partially broken away, looking at an outside corner of the container.

Referring now to FIGS. 7 and 8, a plurality of alternately inwardly and outwardly offset portions 22 and 24 respectively, formed on each side wall 18, 20 extend upwardly from the bottom. The inwardly offset portion 22 has an interior portion 26 and an exterior portion 28, as can be seen in FIG. 4. A generally horizontal shoulder 36 defines the upper edge of interior portion 26. Referring now to FIG. 9, integrally formed at the top of outwardly offset portion 24 is an M-shaped support web 48. Integrally formed in side wall 20 adjacent to outwardly offset portion 24 is inwardly offset portion 22, as seen in FIG. 7. This structure causes the alternately inwardly and outwardly offset configuration of portions 22, 24, as described above.

Referring back to FIG. 1, a stacking shelf 30 is mounted on each side wall for adapting the container 10 to be stacked when shelf 30 is in its downward stacking position as at line 6—6 or to be nested when shelf 30 is in its upward nesting position as at line 4—4. A plurality of bail structures 32 are formed in and horizontally spaced along shelf 30. As can best be seen in FIG. 6, flange 50 is formed near the top of the interior portion 26 of inwardly offset portion 22. Exterior portion 28 has a substantially vertical upper portion 52, a downwardly and inwardly inclined portion 54, and a substantially upwardly and inwardly inclined portion 56. Integrally formed between portions 54 and 56 is rounded pivot portion 58. Bail structure 32 has a backward J-shaped portion 60 which is receivable between flange 50 of interior portion 26 and the rounded pivot portion 58 of exterior portion 28. J-shaped portion 60 need not contact flange 50 as it slides along pivot portion 58.

Figure 6:
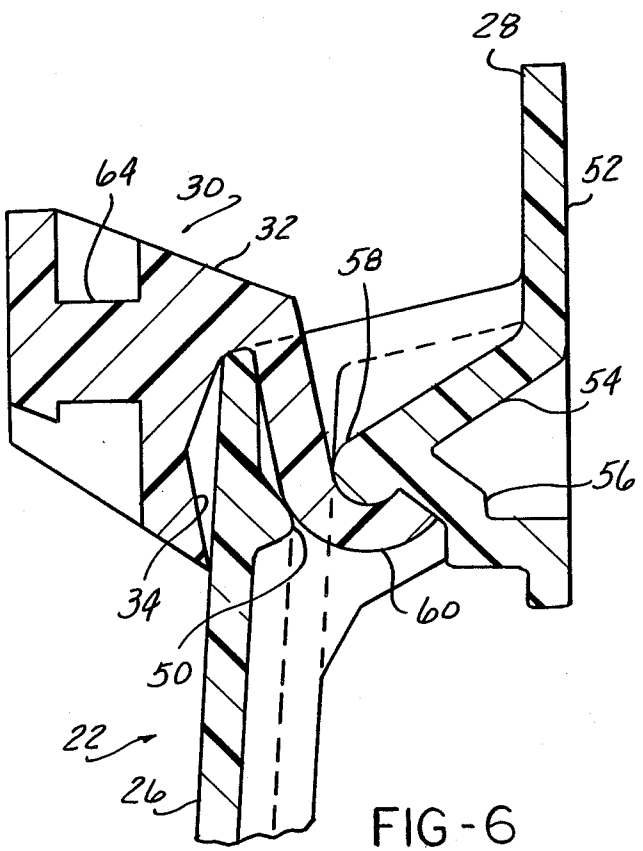
FIG. 6 is an enlarged cross section taken on lines 6—6 of FIG. 1 showing the bail structure in its downward stacking position.
Figure 5:
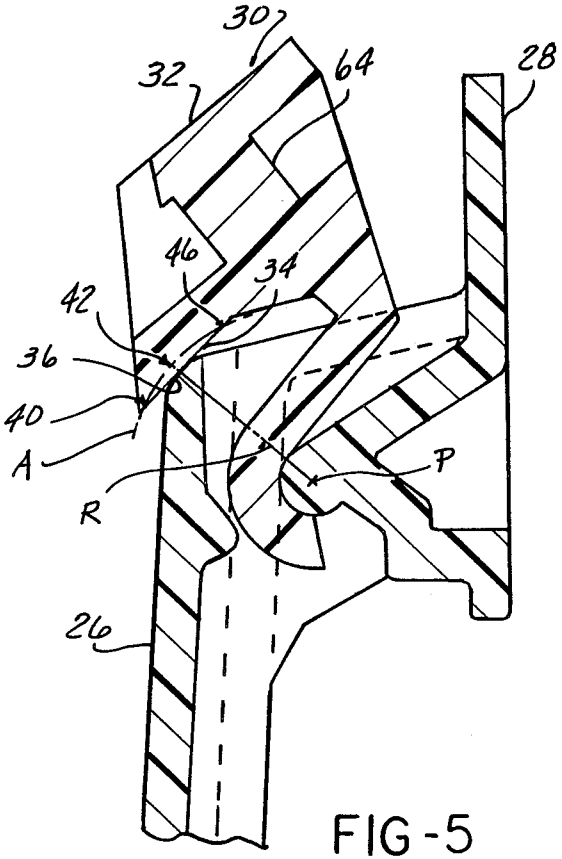
FIG. 5 is the cross section of FIG. 4 showing the bail structure in an intermediate position between the nesting and stacking positions.

Container 10 further comprises a yieldingly resisting interference means in the form of a generally flat interference surface 34 located on bail structure 32 which contacts the inwardly offset portion 22 at its generally horizontal shoulder 36, as can best be seen in FIG. 4. The innermost edge of interference surface 34 need not end precisely at the upper edge of shoulder 36. Rather, in the preferred embodiment, surface 34 hangs slightly over the edge (not shown in the drawings). Referring now to FIG. 5, generally flat interference surface 34 lies in a plane defining a chord cut through a circular arc A having a radius r wherein radius r is approximately equal to a distance fromm a horizontal axis through the point P about which shelf 30 pivots, to an uppermost inward region 38 of the generally horizontal shoulder 36. The horizontal axis through point P extends longitudinally of side wall 20 at a location below and outwardly of wall 20 from shoulder 36. Shelf 30 is pivotal about the axis, between a stacking position wherein shelf 30 overlies and projects inwardly of shoulder 36, as seen in FIG. 6, and a nesting position wherein shelf 30 is inclined upwardly and outwardly of shoulder 36, as seen in FIG. 4.

Generally flat interference surface 34 is spaced from and oriented relative to the pivotal axis such that the interference surface 34 yieldably slides across shoulder 36 to frictionally resist pivotal movement of shelf 30 through at least an intermediate portion of its movement between the nesting and stacking positions. Referring to FIGS. 4–6, and using a direction from the upward nesting position of shelf 30 to the downward stacking position, the region near point 40 on interference surface 34, which is the first point at which interference surface 34 intersects circular arc A, contacts shoulder 36. The contact between surface 34 and shoulder 36 causes yielding resistance. In the region near point 40, this resistance is slight. However, the resistance increases as interference surface 34 slides along shoulder 36 from point 40 to the region at or about point 42, which is the area of maximum resistance, located at the approximate midpoint of the chord defining the interference surface 34. At this maximum interference point 42, it is most noticeable that interference surface 34 causes shoulder 36 to compress somewhat; this compression being shown in FIG. 5 as a slight thickening of shoulder 36. Once the extra force is expended in order to push shelf 30 past this maximum resistance point 42, the resistance lessens until interference surface 34 contacts point 46, the second point at which the chord intersects circular arc A. Once surface 34 slides past point 46, there is no longer any interference, and stacking shelf 30 continues freely downward into its stacking position, as shown in FIG. 6.

Figure 2:
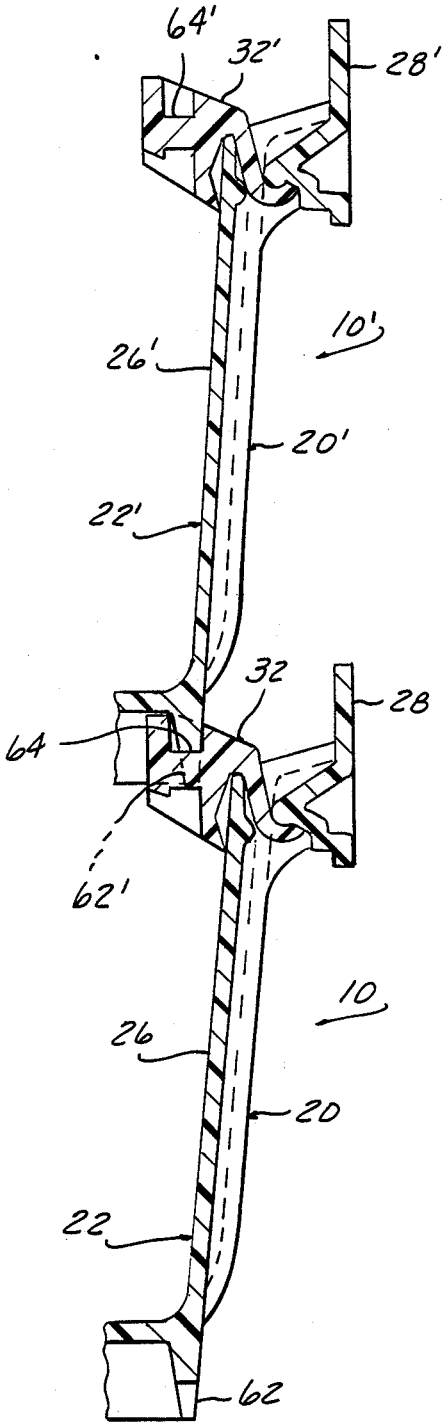
FIG. 2 is a detail cross section taken on line 2—2 of FIG. 8 showing a second container, also in cross section, in the stacked position.

Referring now to FIG. 8, container 10 further comprises a stacking rail 62 formed at the bottom of each opposed side wall 18, 20. As seen in FIG. 2, stacking rail 62 is receivable in a recess 64 which is formed inn bail structure 32 of shelf 30. Recess 64 is adapted to receive a stacking rail 62' from the bottom of a side wall 20' of a like container 10'. In addition to allowing stacking, recess 64 also keeps stacking rail 62 of side walls 18, 20 of stacked containers in their original position. This prevents side walls 18, 20 from buckling under the additional, sometimes substantial weight of stacked containers.

Figure 3:
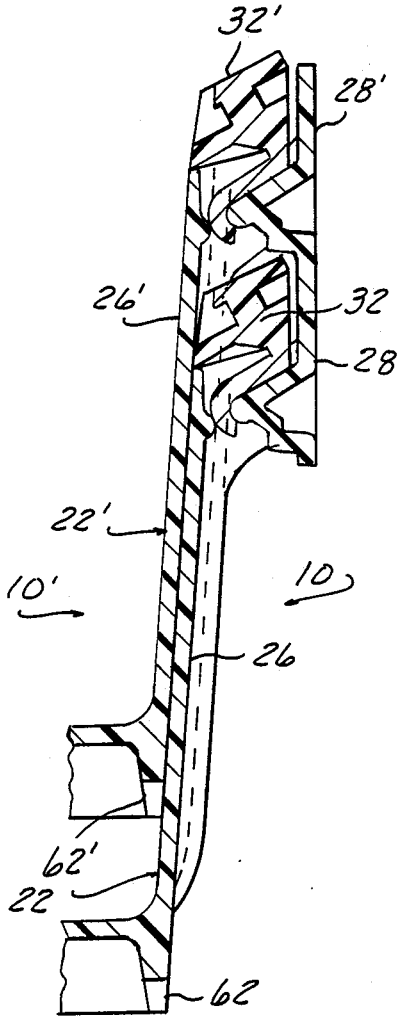
FIG. 3 is a detail cross section taken on line 2—2 of FIG. 8 showing a second container, also in cross section, in the nested position.

When stacking shelf 30 is in the nesting position, container 10 can nest a second container, as shown in FIG. 3. In this nesting position, stacking rail 62' also serves to keep the second container from wedging too tightly in the first container 10. For example, rail 62' would hit bottom 12 before an outward portion 24' of the second container 10' would be completely received by a mating inward portion 22 of the first container 10. Thus, containers will not be wedged tightly together, and removal of one from the other will be facilitated.

It is to be understood that the foregoing description is merely exemplary and not limitative, and the true scope of the invention is that defined in the following claims.

What is claimed is:

1. A nestable and stackable container comprising:

a rectangular bottom;

first and second opposed end walls fixedly secured to and projecting upwardly from respective opposite end edges of the bottom;

first and second opposed side walls fixedly secured to and projecting upwardly from respective opposite side edges of the bottom, the bottom end walls and side walls fixedly secured to each other to form a unitary structure;

a plurality of alternately inwardly and outwardly offset portions on the side walls extending upwardly from the bottom, the inwardly offset portions each having a generally horizontal shoulder defining its upper edge;

a stacking shelf mounted on each side wall for pivotal movement about a horizontal axis extending longitudinally of the side wall at a location below and outwardly of the wall from the shoulder, the shelf being pivotal about the axis, between a stacking position wherein the shelf overlies and projects inwardly of the shoulder, and a nesting position wherein the shelf is inclined upwardly and outwardly of the shoulder;

a stacking rail formed at the bottom of each opposed side wall, the stacking rail being receivable in a plurality of recesses formed in the stacking shelf; and interference means on the shelf in the form of a generally flat interference surface spaced from and oriented relative to the pivotal axis of the stacking shelf for frictionally resisting pivotal movement of the shelf through at least an intermediate portion of its movement between the nesting and stacking positions when the interference surface yieldably slides across the shoulder.

2. The container as defined in claim 1 further comprising a plurality of bail structures formed in and horizontally spaced along the shelf.

3. The container as defined in claim 2 wherein the recesses formed in the stacking shelf are formed in each bail structure, one recess in each bail structure, the recess adapted to receive the stacking rail formed at the bottom of a side wall of a like container.

* * * * *